United States Patent [19]

Voswinckel

[11] Patent Number: 4,728,541

[45] Date of Patent: Mar. 1, 1988

[54] METHOD FOR OPERATING A FINISHING MACHINE

[75] Inventor: Gerhard Voswinckel, Aachen, Fed. Rep. of Germany

[73] Assignee: Gebrüder Sucker & Franz Müller GmbH and Co., Mönchengladbach, Fed. Rep. of Germany

[21] Appl. No.: 811,774

[22] Filed: Dec. 19, 1985

[30] Foreign Application Priority Data

Dec. 19, 1984 [DE] Fed. Rep. of Germany ..... 3446332

[51] Int. Cl.[4] ..... B05D 3/02; B05D 1/36; B05D 3/12; B05D 7/24

[52] U.S. Cl. ..... 427/387; 427/359; 427/385.5; 427/389.9; 427/394; 427/407.1; 427/412; 427/416; 427/424; 427/434.6

[58] Field of Search ..... 28/179, 181, 183, 180, 28/182; 427/175, 387, 407.1, 416, 412, 424, 359, 385.5, 389.9, 394, 434.6; 118/316

[56] References Cited

U.S. PATENT DOCUMENTS

| | | | |
|---|---|---|---|
| 1,944,823 | 1/1934 | Lamont | 118/316 X |
| 3,940,544 | 2/1976 | Marshall et al. | 427/412 X |
| 3,983,272 | 9/1976 | Huber et al. | 427/407.1 |
| 4,019,990 | 4/1977 | Marshall et al. | 252/8.9 |
| 4,025,993 | 5/1977 | Kuroda | 28/181 |
| 4,317,859 | 3/1982 | Smith | 428/392 X |

FOREIGN PATENT DOCUMENTS

| | | | |
|---|---|---|---|
| 2510452 | 9/1976 | Fed. Rep. of Germany | 118/316 |

*Primary Examiner*—Evan K. Lawrence

*Attorney, Agent, or Firm*—Herbert L. Lerner; Laurence A. Greenberg

[57] ABSTRACT

A method of operating a finishing machine includes impregnating all of the threads of an undivided warp formed of individual threads at full thread density with liquid sizing. All of the threads of the undivided warp are directly sprayed at full thread density with a post-treatment separating agent while the sizing is still in the liquid state. The individual threads of the warp are subsequently dried in an undivided manner at full thread density.

3 Claims, 2 Drawing Figures

METHOD FOR OPERATING A FINISHING MACHINE

Figure 1:
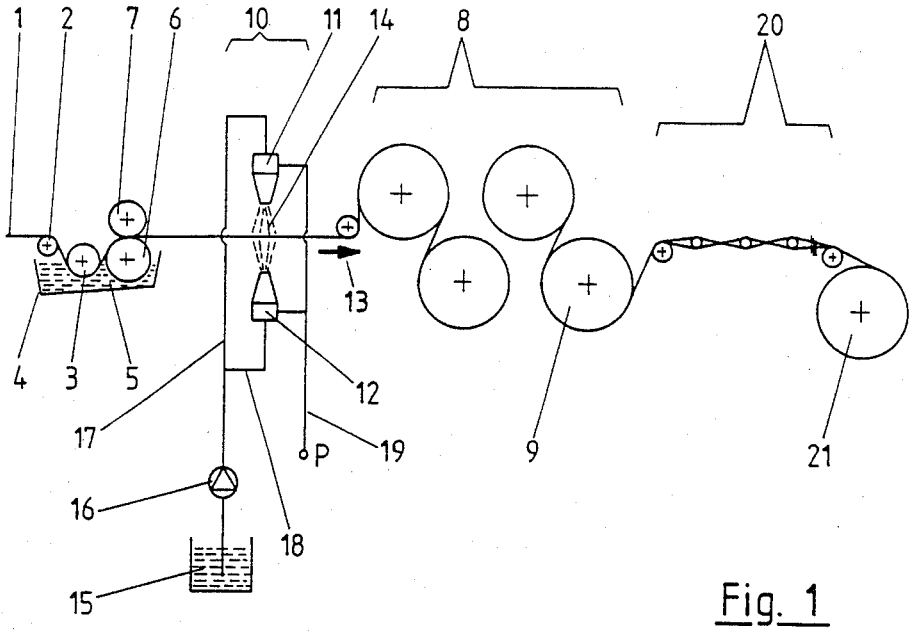

The invention relates to a method for operating a finishing machine, in which the sizing is applied to a warp formed of individual threads or the like and the warp is then dried.

When finishing, the warp threads are generally impregnated by immersion into a sizing trough containing a liquid combination sizing. The trough may contain waxes and separation means, besides the sizing product proper. There is a distinction between the relatively inexpensive base sizings or core sizings, with which about 80% of the volume of the individual threads are filled, and high-quality jacket sizings for the surface of the thread. The jacket sizings improve the elasticity and abrasion resistance of the individual thread. The individual threads are stiffened by means of the core sizing. Core sizing is also required, among other reasons, because the jacket sizing only poorly adheres to a dry thread which has not been sized. The above-mentioned sizing types may contain wax-like substances to improve the slideability and the abrasion resistance of the individual thread in particular. By waxing the threads, a reduction of the dust development during the subsequent weaving is also achieved.

According to the explanation given above, it would make sense to first treat the thread volume with the core sizing and to subsequently treat the thread surface with a jacket sizing and optionally with the wax by immersion into separate troughs. Although the respectively immersed group of threads could be squeezed out following each trough, due to the maximum application of sizing, etc., it is impossible to prevent product from being taken from a preceding trough into a following trough with the impregnated and still wet warp, which causes the more valuable product to be increasingly diluted with the less valuable product. With this mode of operation, jacket sizing becomes unusuble after a short period of operation due to the admixture of the core sizing.

When sizing, there is still another problem in order to achieve uniform jacketing of the warp thread and to optimize the hairiness of the threads, the textile warp is frequently subdivided and processed further in the subdivided condition in parallel dryers after the application of the (core) sizing and optionally the jacket sizing and possibly additional waxes, because the threads otherwise have the tendency to stick together. The threads are therefore only brought together again after the dryer, so as to avoid direct contact of one warp thread with another. Spacings which may be up to about 1.5 mm are set from thread to thread.

Along the separate paths between the finishing machines and the respective dryer, which usually have different lengths, different tensions may occur in the warp sections formed for separating the threads due to different shrinkage and expansion behavior, so that it is difficult to bring the warp sections back together again properly in winding the beam. In the extreme case, warp beams are first individually finished and are only assembled after drying. In any case, the handling of different warp sections is more labor intensive than the handling of the entire warp; for some articles such as warps, subdividing the warp, such as in a cylindrical dryer, is only possible with limitations.

It is accordingly an object of the invention to provide a method for operating a finishing machine, which overcomes the hereinafore-mentioned disadvantages of the here-tofore-known methods of this general type, and which makes it possible to apply (and correctly place) a post-treatment agent, particularly a synthetic jacket sizing, an additional smoothing wax or the like, to the surfaces of the threads of a warp which had been impregnated immediately before with core sizing and are still wet, without the danger of an admixture of the core sizing substance into the reservoirs of the post-treatment agents. The invention should also make it possible to run the warp with the full number of threads through a single dryer without the warp threads sticking together and without the danger of problems arising in the subdivision of the warp and when running it through the comb of the associated warping machine.

With the foregoing and other objects of the invention in view there is provided a method of operating a finishing machine, which comprises impregnating a warp formed of individual threads with liquid sizing, spraying the warp with a post-treatment agent while the sizing is still in the liquid state, and subsequently drying the individual threads of the warp in an undivided manner.

The post-treatment agent is to be sprayed from nozzles, preferably as a fine mist from above and below directly on the warp, i.e., on the threads forming the warp. The problem underlying the invention is accordingly solved substantially by the combination of location and type of application of the post-treatment agent. If, for instance, separating means are sprayed on a warp freshly impregnated with (any) sizing from nozzles, the warp can be dried at its full density. While the drying process itself is not limited thereby, i.e., drying must proceed in the usual manner, the entire warp can be run through the dryer while combined in its full density.

According to the invention, primarily jacket sizings, additional waxes and/or separating means can be considered as post-treatment agents. A jacket sizing is used if separation of the core and the jacket sizing is desired. Additional wax is used if the slideability and the abrasion resistance of the threads are specifically to be increased and the development of dust from the warp during weaving is to be reduced. Separating means are provided particularly in order to preclude sticking of threads located closely together during the drying.

By spraying the warp with the post-treatment agent which was already pre-treated in one or more steps according to the invention, a minimum application and the correct placement with reduced expenditure for the respective spraying substance are achieved at the same time. In addition, mixing of the individual product reservoirs cannot take place.

According to the invention, a group of threads can be acted upon selectably by a jacket sizing, additional wax and/or a separation agent by spraying on this substance after prior impregnation by immersion (with subsequent squeezing) depending on the type of impregnating liquid, such as core sizing or combination sizing. The impregnation by immersion is therefore followed by at least one spraying process for treating the thread surface with a post-treatment agent which is as a rule relatively expensive. In no case does the penetrated thread come into contact with the reservoir of the respective post-treatment agent. The clear separation of the individual process steps permits the achievement of optimum elasticity values by proper jacket sizing as well as the achievement of optimum sliding values by proper separate waxing, and it permits drying after the separating agent is sprayed on, with the full number of threads in the warp.

The possible separating agents to be sprayed on are understood in the art to include additives designated as sliding agents or antiblocking agents for setting the desired anti-adhesion and fixing properties. Examples of separating agents and such groups of additives are metal soaps, mineral paraffin waxes, wax-like polymers, higher fatty alcohols and fatty acid esters, silicones and the like. The separating agent chemically prevents sticking of warp threads or fiber ends extending away from the threads to adjacent warp threads. Therefore, the warp can not only be dried after the separating agent is sprayed on in the full group of threads, but the warp can also be divided readily in the partial drying area if desired, and a perfect sizing jacket is obtained.

Spraying on separating agents following the immersion application and the spray application of further products if applicable, are used particularly in the case of dense warps or for warps which have a tendency to stick together due to their hairiness, so that the usually difficult and expensive alternative with two-fold to fourfold subdivision of the warp in the dryer can be omitted and a warp with individual threads which are sized uniformly all around and are elastic, slideable and abrasion-proof and do not produce dust can be obtained nevertheless. In addition, in the case of critical articles, especially those with a tendency to become twisted, a mutual bracing of the warp threads sprayed with the separation agent is achieved through preservation of the full warp density, so that the danger of warp breakage in the drying section or in the comb of the warping device is also reduced.

Finally, during finishing, particularly during warp finishing of substantially spun-over filament yarn, the tendency of the individual capillaries of a yarn assembly with capillaries of an adjacent yarn assembly to stick together, caused by spraying on separating agent, is suppressed to such a degree that it is also possible in this case to run through a dryer without subdividing the filament yarns. Lateral contact of the individual filament yarns sprayed with a separating agent in the dryer neither leads to sticking nor to thread breakage in spite of intensive air motion during the drying. In the treatment of threads sprayed with separation agent, the expensive air predrying is frequently used, can even be reduced to a minimum so that one can work almost exclusively with the intensive and economical cylinder drying.

The use of the teachings according to the invention is advantageous if a smoothing device for the threads is inserted following the finishing, so that the smoothing effect is also preserved when drying the dense warp by the subsequent spraying on of a separating agent.

When selecting the individual post-treatment agent, its effect on the remaining impregnating and post-treatment agents as well as its effect in the further process steps may have to be considered in the manufacture and possibly in the finishing. Finally, in the selection of the post-treatment agent, it may be advantageous to pay attention to the question of whether or not it can be removed without difficulty when the sizing is removed. The total amount of sprayed on post-treatment agent is in the order of 0.5 to 1.5% by weight of the treated thread, independently of the fineness of the yarn.

Other features which are considered as characteristic for the invention are set forth in the appended claims.

Although the invention is illustrated and described herein as embodied in a method for operating a finishing machine, it is nevertheless not intended to be limited to the details shown, since various modifications and structural changes may be made therein without departing from the spirit of the invention and within the scope and range of equivalents of the claims.

Figure 2:
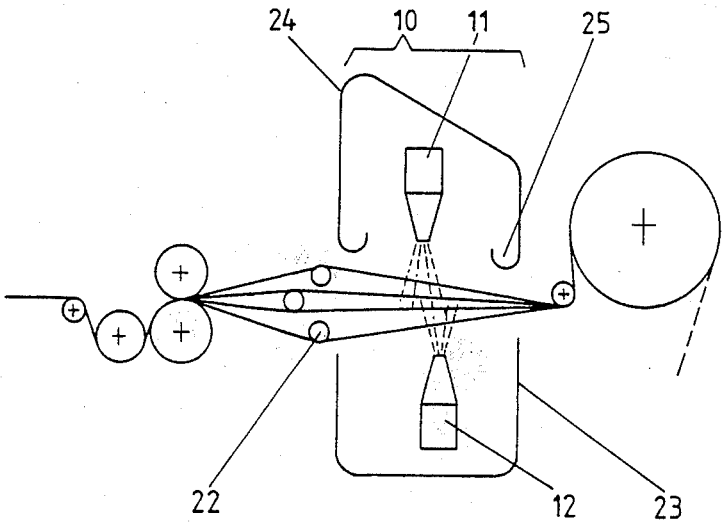

The method of operation of the invention, however, together with additional objects and advantages thereof will be best understood from the following description of the accompanying drawings, in which:

FIG. 1 is a fragmentary, partly longitudinal-sectional view of a finishing machine for carrying out the method with a separating agent spraying device inserted between the sizing applicator and the sizing dryer; and FIG. 2 is an enlarged view of another mebodiment of a portion of the finishing machine according to FIG. 1 with a warp divided in the vicinity of the separating agent spraying device by separating or smoothing rods.

Referring now to the figures of the drawings in detail and first, particularly, to FIG. 1 thereof, there is seen a warp 1 which is conducted with its full density over a control roll 2 and an immersion roll 3 through sizing 5 contained in a trough 4. Elements 2, 3 and 4 can be referred to as a sizing applicator. The warp 1 is then passed on in the usual manner through the slit or joint between a pair of squeezing rolls formed of a lower roll 6 and an upper roll 7. The warp 1 runs through a separating agent spraying device according to the invention which is designated as a whole with reference numeral 10, on the way to a sizing drying device formed substantially of cylindrical drying drums 9 and designated as a whole with reference numeral 8.

According to FIG. 1, the separating agent spraying device 10 is formed of an upper nozzle 11 and a lower nozzle 12. The upper nozzle 11 and the lower nozzle 12 may be formed of a row of individual nozzles, a field of individual nozzles, a slit nozzle extending transversely to the transport direction 13, or the like. A fine spraying mist 14 is sprayed from above and below onto the warp 1 from the nozzles 11, 12. The nozzles 11, 12 can be supplied with the separating agent to be sprayed from a separating agent reservoir 15, by means of a pump 16 and lines 17 and 18. The nozzles 11, 12 can be connected to a compressed air line 19 for spraying the transported separating agent.

In the embodiment according to FIG. 1, the warp 1 is conducted in an undivided manner and with its full density in the direction of transport through the separating agent spraying device 10, through the drying device or dryer 8, as well as through a dryer section 20 to a warping machine with a warp beam 21.

If difficulties should arise in supplying separating agent to the individual warp threads of the undivided warp in a sufficiently uniform manner, it may be advantageous to divide the warp before entering the separating agent spraying device 10, according to FIG. 2. Preferably, separating or smoothing rods 22 are used at this point, which at the same time represent a smoothing device for the threads impregnated with the sizing, in such a manner that the threads retain a smoothness sufficient for further processing by the subsequent application of the separating agent, even beyond the subsequent drying of the dense warp.

In the portion of the finishing machine shown in FIG. 2, the feed lines leading to the nozzles 11, 12 can be constructed substantially as in FIG. 1. The application of the sizing as well as the drying and warping can be performed without change. In FIG. 2, a tray 23 and a drip sheet 24 with a runoff channel 25 are shown diagramatically in the vicinity of the separating agent spraying device 10. In principle, the tray 23 can be constructed as a separating agent reservoir 15 according to FIG. 1 or it can be connected to such a reservoir. Optionally, the pump 16 with the lines 17 and 18 connected thereto according to FIG. 1 can therefore be connected to the tray 23. Depending on the type of separating agent and the kind of spraying method used, it may be sufficient to place a drip sheet 24 above the spraying region or even to use compartments which are closed except for entrance and exit slots for the warp 1.

If a different post-treatment agent is to be sprayed on the warp (instead of the separating agent), substantially the same spraying devices can be used, and two or more spraying devices can also be connected in series for the successive spraying of different post-treatment agents.

Finally, heated as well as cold post-treatment agents can be applied to the warp by the spraying devices.

I claim:

1. Method of operating a finishing machine, which comprises impregnating all of the threads of an undivided warp formed of individual threads at full thread density with liquid sizing, directly spraying all of the threads of the undivided warp at full thread density with a post-treatment separating agent while the sizing is still in the liquid state, and subsequently drying the individual threads of the warp in an undivided manner at full thread density.

2. Method according to claim 1, which comprises spraying substantially 0.5 to 1.5% by weight of the post-treatment agent on the warp, relative to the weight of the threads.

3. Method according to claim 1, which comprises applying the post-treatment agent as a finely sprayed mist.

* * * * *